US012185892B1

(12) United States Patent
Awad

(10) Patent No.: US 12,185,892 B1
(45) Date of Patent: Jan. 7, 2025

(54) SINK JET SPRAYER SYSTEM

(71) Applicant: Amir Awad, Ledgewood, NJ (US)

(72) Inventor: Amir Awad, Ledgewood, NJ (US)

( * ) Notice: Subject to any disclaimer, the term of this patent is extended or adjusted under 35 U.S.C. 154(b) by 326 days.

(21) Appl. No.: 17/839,592

(22) Filed: Jun. 14, 2022

(51) Int. Cl.

| | |
|---|---|
| ***E03C 1/182*** | (2006.01) |
| ***A47L 15/00*** | (2006.01) |
| ***A47L 15/42*** | (2006.01) |
| ***E03C 1/266*** | (2006.01) |

(52) U.S. Cl.
CPC ..... *A47L 15/0086* (2013.01); *A47L 15/4219* (2013.01); *A47L 15/4223* (2013.01); *E03C 1/182* (2013.01); *E03C 1/2665* (2013.01); *A47L 2501/03* (2013.01)

(58) Field of Classification Search
CPC . E03C 1/14; E03C 1/182; E03C 1/184; E03C 1/24; E03C 1/242–244; E03C 1/266–2665; A47L 15/02; A47L 15/08; B02C 18/0092
See application file for complete search history.

(56) References Cited

U.S. PATENT DOCUMENTS

| | | | | |
|---|---|---|---|---|
| 2,669,240 | A * | 2/1954 | Thorson | A47L 15/0086 134/191 |
| 3,358,702 | A | 12/1967 | Schaap | |
| 3,591,095 | A * | 7/1971 | Di Stefano | B02C 18/0092 241/46.06 |
| 3,863,657 | A * | 2/1975 | Irving | A47L 15/02 134/107 |
| 4,919,162 | A | 4/1990 | Lumby | |
| 5,249,749 | A | 10/1993 | Krebsbach | |
| 5,934,298 | A | 8/1999 | Singh | |
| 6,289,530 | B1 * | 9/2001 | Miller | A47L 15/0086 134/102.1 |
| 6,659,114 | B2 * | 12/2003 | Bigott | A47L 15/00 134/108 |
| 7,028,697 | B2 * | 4/2006 | Christman | A47L 15/4244 134/103.3 |
| 9,265,400 | B2 * | 2/2016 | Bigott | A47L 15/08 |
| D759,423 | S | 6/2016 | Gamble | |
| 10,588,478 | B2 * | 3/2020 | Alali | E03C 1/048 |
| 2019/0257061 | A1 * | 8/2019 | Frink | E03C 1/22 |

FOREIGN PATENT DOCUMENTS

| | | |
|---|---|---|
| EP | 1358833 | 10/2005 |

* cited by examiner

*Primary Examiner* — David P Angwin
*Assistant Examiner* — Nicholas A Ros
(74) *Attorney, Agent, or Firm* — Kyle A. Fletcher, Esq.

(57) ABSTRACT

The sink jet sprayer system is a cleaning device. The sink jet sprayer system is adapted for use with cookware, cutlery, and crockery. The sink jet sprayer system recirculates a cleaning solution through a fluidic circuit such that the sink jet sprayer system cleans the cookware, cutlery, and crockery. The sink jet sprayer system installs in the DWV (Drain, Waste, and Vent System) of a domestic plumbing system. The sink jet sprayer system comprises a sink, a garbage disposal, a directional control valve, and a check valve. The sink, the garbage disposal, and the directional control valve forms the fluidic circuit through which the cleaning solution circulates. The check valve prevents the backflow of fluid from the DWV into directional control valve.

14 Claims, 4 Drawing Sheets

SINK JET SPRAYER SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of domestic plumbing installations for sinks, more specifically, disintegrating apparatus specially adapted for installation in waste pipes. (E03C1/266)

SUMMARY OF INVENTION

The sink jet sprayer system is a cleaning device. The sink jet sprayer system is adapted for use with cookware, cutlery, and crockery. The sink jet sprayer system recirculates a cleaning solution through a fluidic circuit such that the sink jet sprayer system cleans the cookware, cutlery, and crockery. The sink jet sprayer system installs in the DWV (Drain, Waste, and Vent System) of a domestic plumbing system. The sink jet sprayer system comprises a sink, a garbage disposal, a directional control valve, and a check valve. The sink, the garbage disposal, and the directional control valve forms the fluidic circuit through which the cleaning solution circulates. The check valve prevents the backflow of fluid from the DWV into directional control valve.

These together with additional objects, features and advantages of the sink jet sprayer system will be readily apparent to those of ordinary skill in the art upon reading the following detailed description of the presently preferred, but nonetheless illustrative, embodiments when taken in conjunction with the accompanying drawings.

In this respect, before explaining the current embodiments of the sink jet sprayer system in detail, it is to be understood that the sink jet sprayer system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the sink jet sprayer system.

It is therefore important that the claims be regarded as including such equivalent construction insofar as they do not depart from the spirit and scope of the sink jet sprayer system. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
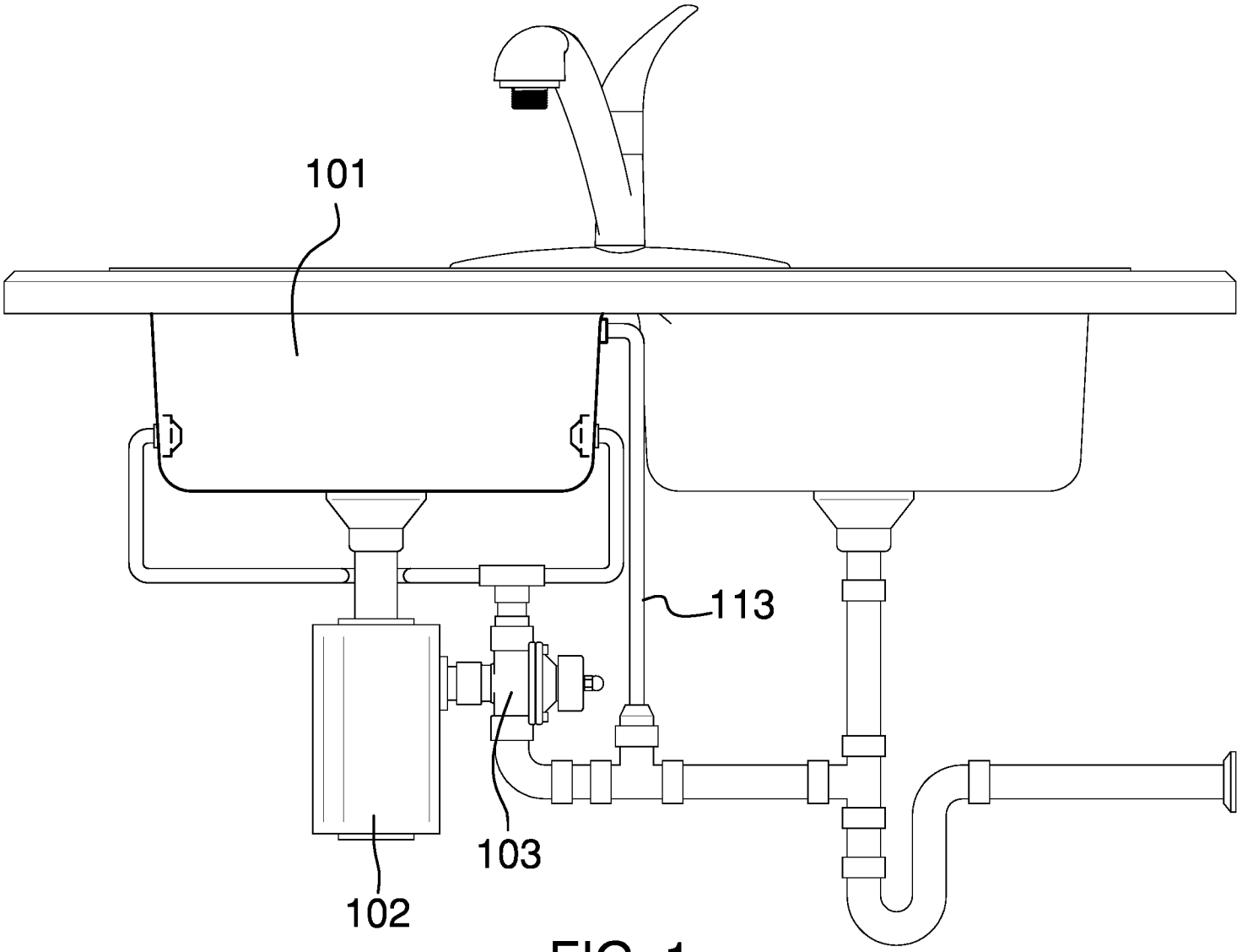
FIG. 1 is a front view of an embodiment of the disclosure.
Figure 2:
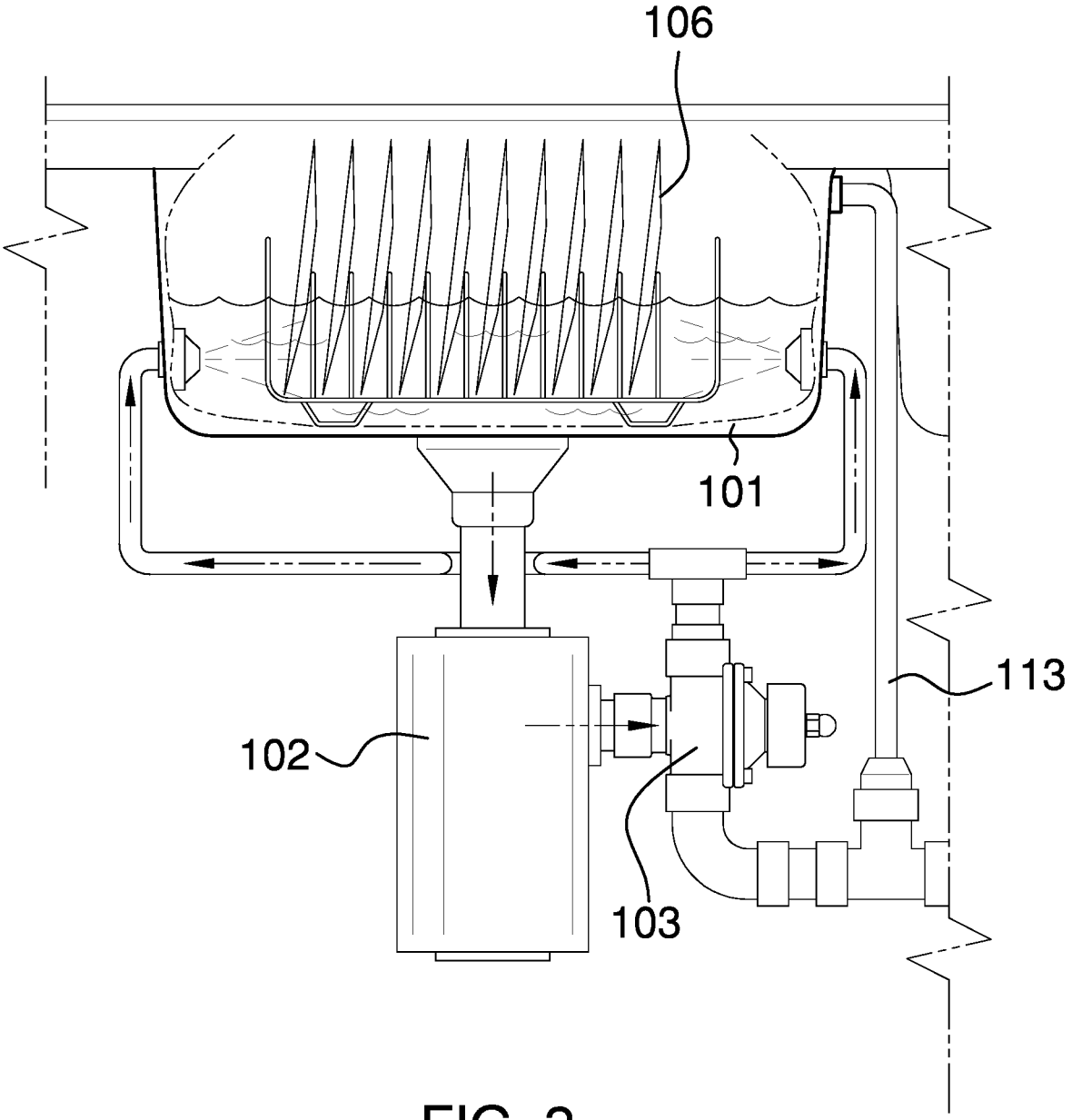
FIG. 2 is an in-use view of an embodiment of the disclosure.
Figure 3:
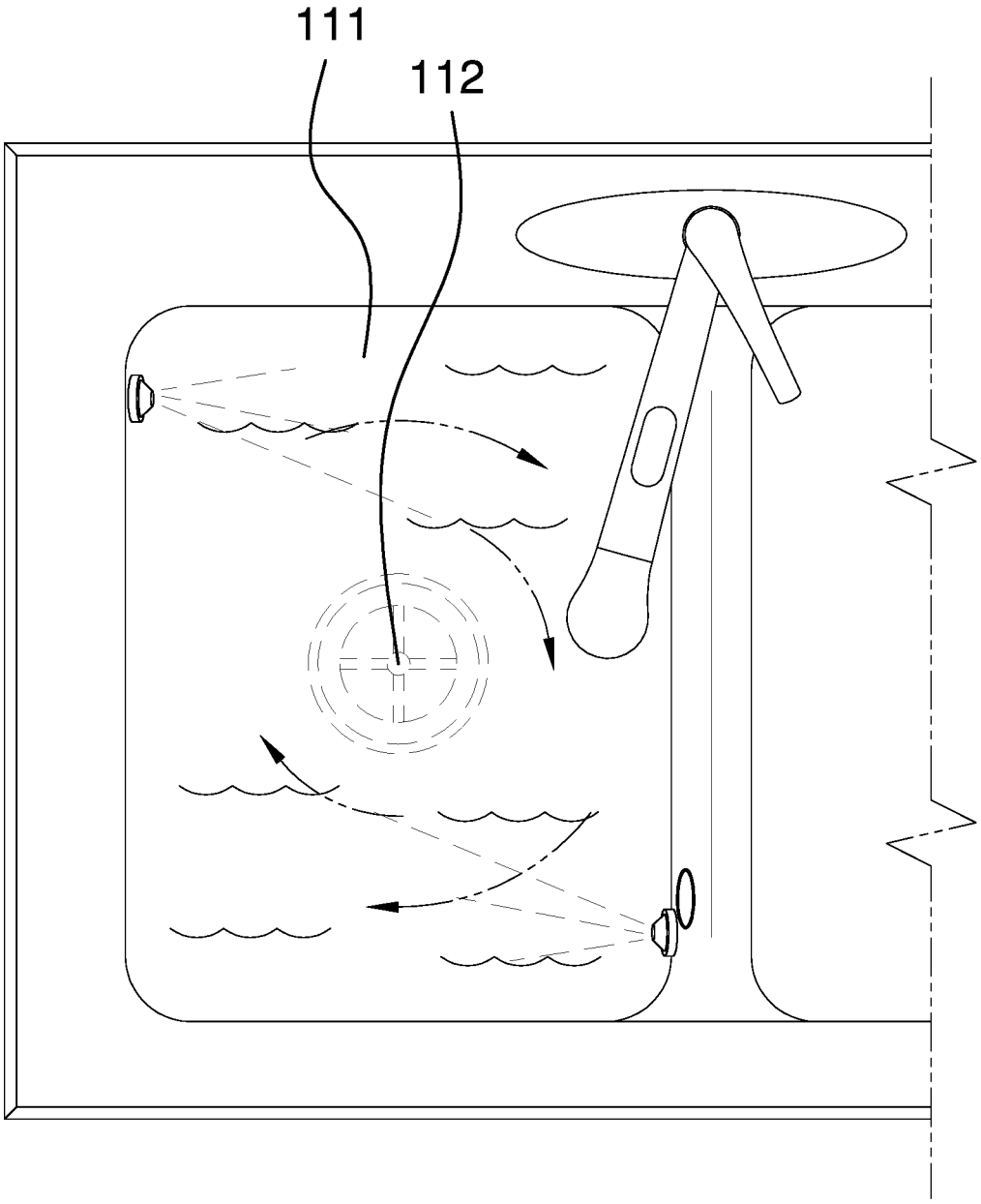
FIG. 3 is a top view of an embodiment of the disclosure.
Figure 4:
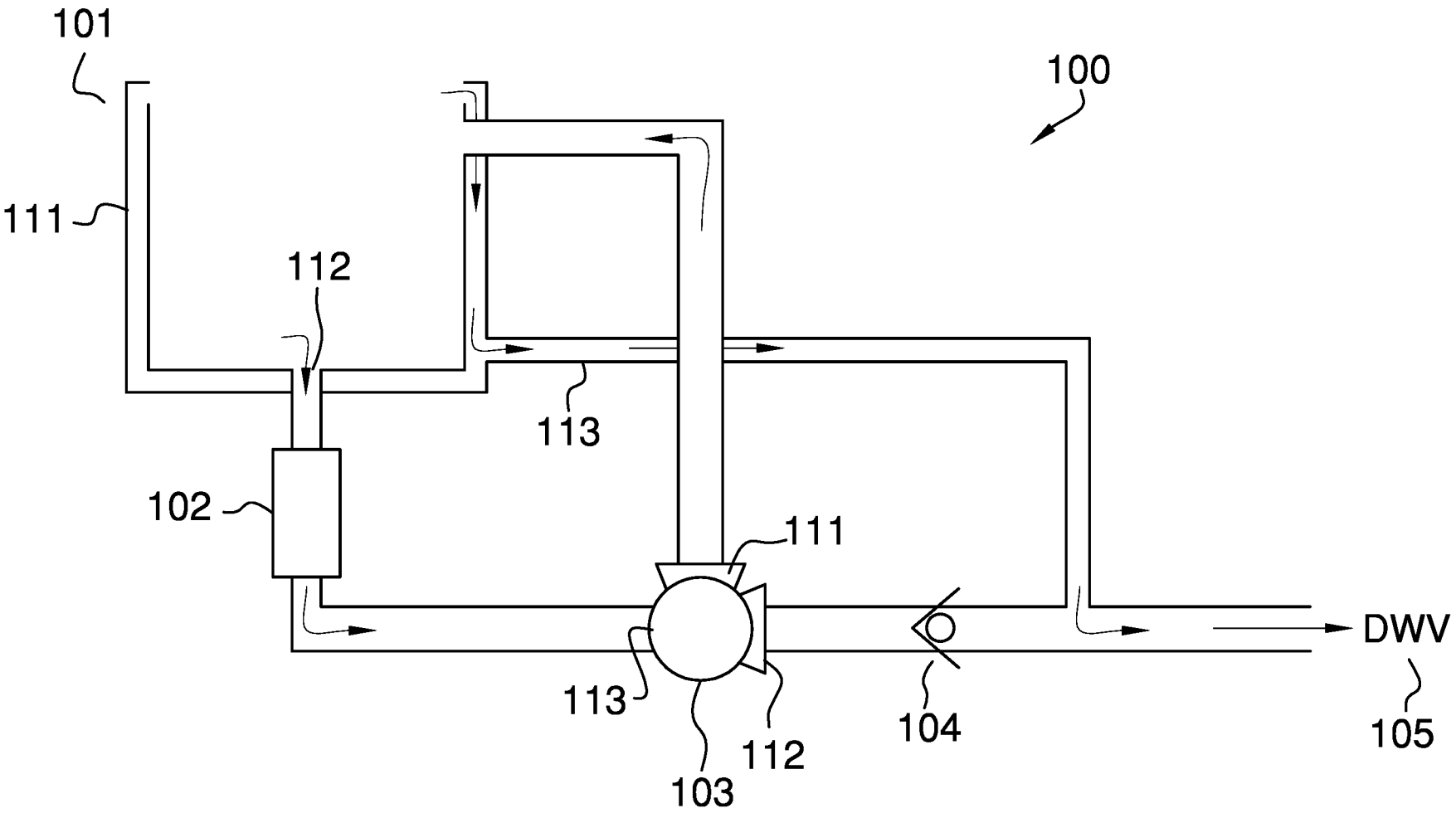
FIG. 4 is a schematic view of an embodiment of the disclosure.

Detailed reference will now be made to one or more potential embodiments of the disclosure, which are illustrated in FIGS. 1 through 4.

The sink jet sprayer system 100 (hereinafter invention) is a cleaning device. The invention 100 is adapted for use with cookware, cutlery, and crockery 106. The invention 100 recirculates a cleaning solution through a fluidic circuit such that the invention 100 cleans the cookware, cutlery, and crockery 106. The invention 100 installs in the DWV 105 (Drain, Waste, and Vent System) of a domestic plumbing system. The invention 100 comprises a sink 101, a garbage disposal 102, a directional control valve 103, and a check valve 104. The sink 101, the garbage disposal 102, and the directional control valve 103 forms the fluidic circuit through which the cleaning solution circulates. The check valve 104 prevents the backflow of fluid from the DWV 105 into directional control valve 103.

The cookware, cutlery, and crockery 106 are placed in the sink 101. The recirculation of the cleaning solution through the fluidic circuit formed by the sink 101, the garbage disposal 102, and the directional control valve 103 passes over the cookware, cutlery, and crockery 106 contained within the sink 101 such that the recirculation of the cleaning solution continuously cleans the cookware, cutlery, and crockery 106.

The DWV 105 is defined elsewhere in this disclosure. The cookware, cutlery, and crockery 106 are defined elsewhere in this disclosure. The cookware, cutlery, and crockery 106 are placed in the sink 101 such that the cookware, cutlery, and crockery 106 are submerged underwater when the invention 100 is recirculating water through the sink 101, the garbage disposal 102, and the directional control valve 103. The garbage disposal 102 discharges the recirculating water into the directional control valve 103 with sufficient pressure such that the grey water will flow through the directional control valve and back into the sink 101. The solid material and bulk solids soiling the cookware, cutlery, and crockery 106 are removed from the cookware, cutlery, and crockery 106 by the recirculating grey water. A cleaning agent is added to the recirculating grey water to form a cleaning solution which enhances the ability of the invention 100 to clean the cookware, cutlery, and crockery 106.

The sink 101 is a device associated with a domestic plumbing system. The sink 101 forms an interface between the supply side of the domestic plumbing system and the DWV 105 of the domestic plumbing system. The sink 101 receives and stores fresh water provided by the supply side. The sink 101 discharges the received water into the garbage disposal 102 after the water is used. The sink 101 is defined elsewhere in this disclosure. The sink 101 comprises a basin 111, a drain 112, and an overflow structure 113.

The basin 111 is a pan-shaped structure. The basin 111 forms a contained space used to store the cookware, cutlery, and crockery 106. The basin 111 is a fluid impermeable structure used to store the water used to clean the cookware, cutlery, and crockery 106 that is submerged in the basin 111. The basin 111 forms a fluidic connection with the directional control valve 103 such that the grey water discharged by the directional control valve 103 will recirculate back into the basin 111.

The drain 112 is a fluidic connection used to remove the grey water from the basin 111. The drain 112 forms a fluidic connection with the garbage disposal 102 such that water discharged from the basin 111 through the drain 112 flows directly into the garbage disposal 102. The solid material and bulk solids soiling the cookware, cutlery, and crockery 106 flow with the grey water through the drain 112 into the garbage disposal 102.

The overflow structure 113 is a fluid transport structure. The overflow structure 113 is formed in the basin 111. The overflow structure 113 forms a fluidic connection with the basin 111. The overflow structure 113 receives fluid overflow from the basin 111. The term overflow is defined elsewhere in this disclosure. The overflow structure 113 transports the received fluid overflow from the basin 111 directly into the DWV 105. The overflow structure 113 bypasses the garbage disposal 102, the directional control valve 103, and the check valve 104 such that the fluid overflow will not recirculate back into the basin 111. The overflow structure 113 forms a fluidic connection with the DWV 105 such that the check valve 104 is positioned between the directional control valve 103 and the discharge from the overflow structure 113 into the DWV 105.

The garbage disposal 102 is a mechanical device. The garbage disposal 102 installs into the fluid flow of the DWV 105. Specifically, all the water discharged from the sink 101 flows through the garbage disposal 102 to enter the DWV 105. The garbage disposal 102 mechanically grinds the solids and bulk solids flowing with the water as the water passes through the garbage disposal 102. The garbage disposal 102 is independently controlled. By independently controlled is meant that the operation of the garbage disposal 102 is not dependent on the amount of water flowing through the garbage disposal 102. By independently controlled is further meant that the operation of the garbage disposal 102 is not dependent on the operational status of the directional control valve 103.

The garbage disposal 102 forms a fluidic connection with the drain 112 of the sink 101. The garbage disposal 102 receives as its input the water flowing out of the sink 101. The garbage disposal 102 forms a fluidic connection with the intake port 123 of the directional control valve 103. The garbage disposal 102 discharges the received water and the ground materials into the directional control valve 103.

The directional control valve 103 is an electrically controlled valve. The electrically controlled valve is defined elsewhere in this disclosure. The directional control valve 103 receives grey water from the garbage disposal 102. The directional control valve 103 routes the received grey water into a flow path formed within the DWV 105. The directional control valve 103 routes the received grey water into a flow path selected from the group consisting of: a) returning the grey water back into the sink 101; and, b) discharging the grey water through the check valve 104 into the DWV 105.

The directional control valve 103 is a switchable structure. By switchable structure is meant that the flow path of the directional control valve 103 can be alternated between: a) returning the grey water to the sink 101; and, b) discharging the grey water through the check valve 104 into the DWV 105.

The directional control valve 103 is independently controlled. By independently controlled is meant that the operation of the directional control valve 103 is not dependent on the amount of water flowing through the directional control valve 103. By independently controlled is further meant that the operation of the directional control valve 103 is not dependent on the operational status of the garbage disposal 102.

The directional control valve 103 forms a fluidic connection with the garbage disposal 102. The directional control valve 103 forms a fluidic connection with the check valve 104. The directional control valve 103 forms a fluidic connection with the sink 101.

The directional control valve 103 comprises a first discharge port 121, a second discharge port 122, and an intake port 123.

The first discharge port 121 is a discharge port of the directional control valve 103. The first discharge port 121 forms a fluidic connection with the basin 111 of the sink 101 such that the grey water flows from the first discharge port 121 into the basin 111. The second discharge port 122 is a discharge port of the directional control valve 103. The second discharge port 122 forms a fluidic connection with the check valve 104 such that the grey water flows from the first discharge port 121 into the check valve 104.

The intake port 123 is the intake port 123 of the directional control valve 103. The intake port 123 forms a fluidic connection with the garbage disposal 102 such that the grey water discharged by the garbage disposal 102 flows into the directional control valve 103 through the intake port 123.

The check valve 104 is a valve that limits the flow of fluid through the check valve 104 to a single direction. The check valve 104 is defined elsewhere in this disclosure. The check valve 104 is installed such that grey water only flows from the directional control valve 103 towards DWV 105. The check valve 104 is further installed such that the grey water flowing from the overflow structure 113 of the sink 101 into the DWV 105 will not back flow through the check valve 104 into the directional control valve 103.

The following definitions were used in this disclosure:

Ball: As used in this disclosure, a ball refers to an object with a spherical or nearly spherical shape.

Ball Check Valve: As used in this disclosure, a ball check valve is a type of check valve. A ball check valve is a valve that has a ball inserted into it such that the ball move freely within the valve structure. The flow of fluid applies a force to the ball check valve that provides the motive forces that move the ball within the valve structure. The ball check valve is structured such that the flow of a fluid through the ball check valve in a first direction presses the ball into the flow path of the fluid through the ball check valve such that the fluid will apply a pressure against the ball that closes the fluid flow path through the ball check valve in the first direction. The ball check valve is further structured such that the flow of a fluid through the ball check valve in a second direction pushes the ball out of the flow path of the ball check valve such that the ball check valve allows the flow of fluid in the second direction. The second direction is the opposite direction to the first direction.

Basin: As used in this disclosure, a basin is an open container configured to receive a fluid and manage a fluid.

Bulk Solid: As used in this disclosure, a bulk solid is a material that is formed from an accumulation of discrete particles. While the discrete particles of the bulk solid are solid materials, in aggregate the physical performance of bulk solid will exhibit fluid characteristics such as flow or taking the shape of a container.

Check Valve: As used in this disclosure, a check valve is a valve that permits the flow of fluid in a single direction. Within selected potential embodiments of this disclosure, the check valve is a commercially available product that is selected from the group consisting of a ball check valve and a Tesla valve.

Clean: As used in this disclosure, the term clean refers to an object without dirt, unwanted markings, or undesirable pathogens. When referring to a surface, the term clean can also refer to removing unwanted objects from the surface. The term cleaning refers to the action of making an object clean.

Cleaning Agent: As used in this disclosure, a cleaning agent is a chemical compound used to remove pathogens, dirt and detritus from a surface.

Cleaning Solution: As used in this disclosure, a cleaning solution is a chemical solution that contains a solvent used to dissolve a cleaning agent.

Cookware: As used in this disclosure, cookware refers to containers or tools used in the preparation of foodstuff. Within this definition, containers include, but are not limited to, items such as pots, pans, and bowls. Within this definition, tools include, but are not limited to, cutting boards, colanders, mixing tools, cutting tools, and measuring devices.

Crockery: As used in this disclosure, crockery is a general term that refers to plates, bowls, cups and other vessels that are used in the serving of food and beverages. As used in this disclosure, the term crockery includes vessels such as the cups, glasses, or bottles used for the consumption of beverages. As used in this disclosure, the term crockery excludes cutlery.

Cutlery: As used in this disclosure, cutlery refers to one or more hand tools used by humans for the consumption of food.

Common items of cutlery include, but are not limited to forks, knives, or spoons.

Cycle: As used in this disclosure, a cycle refers to a repeating sequence of one or more events.

Directional Control Valve: As used in this disclosure, a directional control valve is a valve that directs the flow of a fluid into a specific flow path within a fluid network. The basic directional control valve has an intake port that receives the incoming fluid and two or more discharge ports that discharge the fluid into the desired flow path. A directional control valve is often identified as an "N-way X-position valve." The N-way refers to the number of flow paths the directional control valve supports (or, equivalently, the number of discharge ports supported by the directional control valve). The X-position refers to the number of flow configurations the directional control valve supports. For example, a 2-way 4-position direction control valve supports the following configurations: a) permitting the flow of a fluid from the intake port through a first discharge port while preventing the flow of the fluid through a second discharge port; b) permitting the flow of the fluid from the intake port through the second discharge port while preventing the flow of the fluid through the first discharge port; c) permitting the flow of the fluid through both the first discharge port and the second discharge port simultaneously; and, d) preventing the flow of fluid through both the first discharge port and the second discharge port. A spool valve is often used as a directional control valve.

Domestic Plumbing System: As used in this disclosure, a domestic plumbing system refers to a fluidic network that is formed within a building. The domestic plumbing system transports water received from a utility through the building. Specifically, the domestic plumbing system: a) receives fresh water from the utility and distributes the fresh water through the building; and, b) transports gray water generated within the building and returns the gray water back to the utility for disposal. The domestic plumbing system comprises a supply side and a DWV.

Drain: As used in this disclosure, a drain is a mechanical substructure of a larger mechanical structure that uses gravity to remove an object from the larger mechanical structure.

DWV: As used in this disclosure, DWV is an acronym for drainage, waste, and vent. With a domestic plumbing system, DWV refers to the plumbing subnetwork that transports waste water out of the residence to an appropriate waste water handling system.

Electrically Operated Valve: As used in this disclosure, an electrically operated valve is a valve that: a) uses electrical energy to power the actuation of the electrically operated valve; or b) uses electrically generated signals to control the actuation of the electrically operated valve. A solenoid valve is a type of electrically operated valve.

Flow: As used in this disclosure, a flow refers to the passage of a fluid past a fixed point. This definition considers bulk solid materials as capable of flow.

Fluid: As used in this disclosure, a fluid refers to a state of matter wherein the matter is capable of flow and takes the shape of a container it is placed within. The term fluid commonly refers to a liquid or a gas.

Fluidic Circuit: As used in this disclosure, a fluidic circuit is a closed loop path through which a fluid flows. The closed loop will generally initiate and terminate at reservoir.

Fluidic Connection: As used in this disclosure, a fluidic connection refers to a tubular structure that transports a fluid from a first object to a second object. Methods to design and use a fluidic connections are well-known and documented in the mechanical, chemical, and plumbing arts.

Fluid Network: As used in this disclosure, a fluid network refers to a transport structure that: a) receives a fluid into the fluid network; b) transports the fluid through a series of pipes, valves, and manifolds; and, c) discharges the fluid from the fluid network.

Garbage Disposal: As used in this disclosure, a garbage disposal is an electrically powered device that mounts in the flow path of the fluid network formed by the DWV of a domestic plumbing system. The garbage disposal grinds solid matter flowing through the garbage disposal into pieces that will more readily flow through the DWV. The garbage disposal allows for the flow of gray water through the garbage disposal when the garbage disposal is not operating. The garbage disposal is typically installed at the discharge port of a sink located in the kitchen of a building. The garbage disposal is also referred to as an under sink food disposal device.

Gas: As used in this disclosure, a gas refers to a state (phase) of matter that is fluid and that fills the volume of the structure that contains it. Stated differently, the volume of a gas always equals the volume of its container.

Grinder: As used in this disclosure, a grinder is a machine that reduces a material into small particles.

Liquid: As used in this disclosure, a liquid refers to a state (phase) of matter that is fluid and that maintains, for a given pressure, a fixed volume that is independent of the volume of the container.

Negative Space: As used in this disclosure, negative space is a method of defining an object through the use of open or empty space as the definition of the object itself, or, through the use of open or empty space to describe the boundaries of an object.

Overflow: As used in this disclosure, the overflow refers to the release from a contained system of a fluid in an amount that exceeds the containment capacity of the contained system. The term overflow is also used to refer to an auxiliary transport system that transports the excess fluid away from the contained system to a previously designated location. More generally, the term overflow is applied to a system that is receiving a volume of input at a rate that is greater than the system's capacity to process the input.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of prism structure of the pan and/or a portion of the closed lateral faces of the pan is are open.

Phase: As used in this disclosure, phase refers to the state of the form of matter. The common states of matter are solid, liquid, gas, and plasma.

Pipe: As used in this disclosure, a pipe is a hollow prism-shaped device that is suitable for use in transporting a fluid. The line that connects the center of the first base of the prism to the center of the second base of the prism is referred to as the axis of the prism or the centerline of the pipe. When two pipes share the same centerline they are said to be aligned. In this disclosure, the terms inner dimension of a pipe and outer dimension are used as they would be used by those skilled in the plumbing arts.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Recirculate: As used in this disclosure, to recirculate means to cycle the same fluid repeatedly through a fluidic circuit.

Sink: As used in this disclosure, a sink is a permanently installed water basin that is attached to one or more water sources.

Solenoid: As used in this disclosure, a solenoid is a cylindrical coil of electrical wire that generates a magnetic field that can be used to mechanically move a shaft made of a magnetic core.

Solenoid Valve: As used in this disclosure, a solenoid valve is an electromechanically controlled valve that is used to control fluid or gas flow. A two port solenoid valve opens or closes to fluid flow through the valve portion of the solenoid valve. A three port solenoid valve switched fluid or gas flow between a first port and a second port to either feed or be fed from a third port. A solenoid valve comprises a coil and a valve. The coil forms the solenoid that opens and closes the solenoid valve. The solenoid valve is a valve that opens and closes to control the fluid flow.

Solid: As used in this disclosure, a solid refers to a state (phase) of matter that: 1) has a fixed volume; and, 2) does not flow.

Such As: As used in this disclosure, the term "such as" is a conjunction that relates a first phrase to a subsequent phrase. The term "such as" is used to introduce representative examples of structures that meet the requirements of the first phrase. As a first example of the use of the term "such as," the phrase: "the first textile attaches to the second textile using a fastener such as a hook and loop fastener" is taken to mean that a hook and loop fastener is suitable to use as the fastener but is not meant to exclude the use of a zipper or a sewn seam. As a second example of the use of the term "such as," the phrase: "the chemical substance is a halogen such as chlorine or bromine" is taken to mean that either chlorine or bromine are suitable for use as the halogen but is not meant to exclude the use of fluorine or iodine.

Such That: As used in this disclosure, the term "such that" is a conjunction that relates a first phrase to a subsequent phrase. The term "such that" is used to place a further limitation or requirement to the first phrase. As a first example of the use of the term "such that," the phrase: "the door attaches to the wall such that the door rotates relative to the wall" requires that the attachment of the door allows for this rotation. As a second example of the use of the term "such that," the phrase: "the chemical substance is selected such that the chemical substance is soluble in water" requires that the selected chemical substance is soluble in water. As a third example of the use of the term "such that," the phrase: "the lamp circuit is constructed such that the lamp circuit illuminates when the lamp circuit detects darkness" requires that the lamp circuit: a) detect the darkness; and, b) generate the illumination when the darkness is detected.

Supply Side: As used in this disclosure, the supply side refers to the plumbing subnetwork within a domestic plumbing system that provisions fresh water for use within the residence.

Tesla Valve: As used in this disclosure, a Tesla valve is a type of check valve that requires the use of no moving parts.

Utility: As used in this disclosure, a utility is a commercial operation that provides an essential service to a community. The operation of a utility is often: a) regulated by a supervisory authority; or, b) provided by a governmental agency. A utility commonly: a) distributes to the community energy in the form of electricity of natural gas; and, b) distributes to the community fresh water and disposes of gray water that is generated by the community.

Valve: As used in this disclosure, a valve is a device that is used to control the flow of a fluid (gas or liquid) through a pipe, tube, or hose.

With respect to the above description, it is to be realized that the optimum dimensional relationship for the various components of the invention described above and in FIGS. 1 through 4 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A domestic accessory comprising a sink, a garbage disposal, a directional control valve, and a check valve;

wherein the sink, the garbage disposal, and the directional control valve forms a fluidic circuit through which a water based solution circulates;

wherein the sink comprises a basin, a drain, and an overflow structure;

wherein the basin is a pan-shaped structure;

wherein the basin forms a contained space configured to store cookware, cutlery, and crockery;

wherein the basin is a fluid impermeable structure;

wherein the basin forms a fluidic connection with the directional control valve such that the water based solution discharged by the directional control valve will recirculate back into the basin;

wherein the drain is a fluidic connection used to remove the water based solution from the basin;

wherein the drain forms a fluidic connection with the garbage disposal such that water discharged from the basin through the drain flows directly into the garbage disposal;

wherein the overflow structure is a fluid transport structure;

wherein the overflow structure is formed in the basin;

wherein the overflow structure forms a fluidic connection with the basin;

wherein the overflow structure receives fluid overflow from the basin;

wherein the overflow structure transports the received fluid overflow from the basin directly into a drain system (DWV) of a domestic plumbing system;

wherein the overflow structure bypasses the garbage disposal, the directional control valve, and the check valve such that the fluid overflow will not recirculate back into the basin;

wherein the overflow structure forms a fluidic connection with the DWV such that the check valve is positioned between the directional control valve and the discharge from the overflow structure into the DWV.

2. The domestic accessory according to claim 1 wherein the domestic accessory is a cleaning device;

wherein the domestic accessory is adapted for use with the cookware, cutlery, and crockery;

wherein the domestic accessory is configured to recirculate the water based solution through the fluidic circuit such that the domestic accessory cleans the cookware, cutlery, and crockery;

wherein the domestic accessory couples to the DWV.

3. The domestic accessory according to claim 2 wherein the check valve prevents the backflow of fluid from the DWV into the directional control valve;

wherein the sink is configured to receive the cookware, cutlery, and crockery;

wherein the domestic accessory is configured to recirculate the water based solution through the fluidic circuit such that the domestic accessory is configured to clean cookware, cutlery, and crockery placed within the sink.

4. The domestic accessory according to claim 3 wherein the garbage disposal discharges the recirculating water based solution into the directional control valve with pressure such that the water based solution will flow through the directional control valve and back into the sink.

5. The domestic accessory according to claim 4 wherein the sink is a device associated with the domestic plumbing system;

wherein the sink forms an interface between the supply side of the domestic plumbing system and the DWV of the domestic plumbing system.

6. The domestic accessory according to claim 5 wherein the garbage disposal is a mechanical device;

wherein the garbage disposal is fluidly coupled to the DWV;

wherein water discharged from the sink flows through the garbage disposal to enter the DWV;

wherein the garbage disposal mechanically grinds solids and bulk solids flowing with the water as the water passes through the garbage disposal.

7. The domestic accessory according to claim 6 wherein the garbage disposal is independently controlled;

wherein by independently controlled is meant that the operation of the garbage disposal is not dependent on the amount of water flowing through the garbage disposal;

wherein by independently controlled is further meant that the operation of the garbage disposal is not dependent on the operational status of the directional control valve.

8. The domestic accessory according to claim 7 wherein the garbage disposal forms a fluidic connection with the drain of the sink;

wherein the garbage disposal receives as its input the water flowing out of the sink;

wherein the garbage disposal forms a fluidic connection with an intake port of the directional control valve;

wherein the garbage disposal discharges the received water and the ground materials into the directional control valve.

9. The domestic accessory according to claim 8 wherein the directional control valve is an electrically controlled valve;

wherein the directional control valve receives the water based solution from the garbage disposal;

wherein the directional control valve is configured to route the received water based solution into a flow path formed within the DWV;

wherein the directional control valve is configured to route the received water based solution into a flow path selected from the group consisting of:

a) returning the water based solution back into the sink; and, b) discharging the water based solution through the check valve into the DWV.

10. The domestic accessory according to claim 9 wherein the directional control valve is a switchable structure;

wherein by switchable structure is meant that the flow path of the directional control valve can be alternated between: a) returning the water based solution to the sink; and, b) discharging the water based solution through the check valve into the DWV.

11. The domestic accessory according to claim 10 wherein the directional control valve is independently controlled;

wherein by independently controlled is meant that the operation of the directional control valve is not dependent on the amount of water flowing through the directional control valve;

wherein by independently controlled is further meant that the operation of the directional control valve is not dependent on the operational status of the garbage disposal.

12. The domestic accessory according to claim 11 wherein the directional control valve forms a fluidic connection with the garbage disposal;

wherein the directional control valve forms a fluidic connection with the check valve;

wherein the directional control valve forms a fluidic connection with the sink.

13. The domestic accessory according to claim 12 wherein the check valve is a valve that limits the flow of fluid through the check valve to a single direction;

wherein the check valve is installed such that water based solution only flows from the directional control valve towards DWV;

wherein the check valve is further installed such that the water based solution flowing from the overflow structure of the sink into the DWV will not backflow through the check valve into the directional control valve.

14. The domestic accessory according to claim 13 wherein the directional control valve comprises a first discharge port, a second discharge port, and the intake port;

wherein the first discharge port is a discharge port of the directional control valve;

wherein the first discharge port forms a fluidic connection with the basin of the sink such that the water based solution flows from the first discharge port into the basin;

wherein the second discharge port is a discharge port of the directional control valve;

wherein the second discharge port forms a fluidic connection with the check valve such that the water based solution flows from the first discharge port into the check valve;

wherein the intake port is the intake port of the directional control valve;

wherein the intake port forms a fluidic connection with the garbage disposal such that the water based solution discharged by the garbage disposal flows into the directional control valve through the intake port.

* * * * *